US007691552B2

(12) United States Patent
Marcello et al.

(10) Patent No.: US 7,691,552 B2
(45) **Date of Patent: *Apr. 6, 2010**

(54) TONER COMPOSITION

(75) Inventors: Vincenzo G. Marcello, Webster, NY (US); Dennis A. Mattison, Jr., Marion, NY (US); Steven A. VanScott, Fairport, NY (US); Nancy S. Hunt, Ontario, NY (US); Cuong Vong, Hamilton (CA); Vladislav Skorokhod, Mississauga (CA); Richard P. N. Veregin, Mississauga (CA); Michael S. Hawkins, Cambridge (CA); Tie Hwee Ng, Mississauga (CA); Daryl W. Vanbesien, Burlington (CA); Christine Deborah Anderson, Hamilton (CA); Liam S. Cummings, Macedon, NY (US); Louis V. Isganitis, Rochester, NY (US); Allan Chen, Oakville (CA)

(73) Assignee: Xerox Corporation, Stamford, CT (US)

( * ) Notice: Subject to any disclaimer, the term of this patent is extended or adjusted under 35 U.S.C. 154(b) by 717 days.

This patent is subject to a terminal disclaimer.

(21) Appl. No.: 11/504,322

(22) Filed: Aug. 15, 2006

(65) Prior Publication Data

US 2008/0044754 A1 Feb. 21, 2008

(51) Int. Cl.
*G03G 9/093* (2006.01)

(52) U.S. Cl. ..... 430/110.2; 430/109.3

(58) Field of Classification Search ..... 430/110.2, 430/109.3

See application file for complete search history.

(56) References Cited

U.S. PATENT DOCUMENTS

| | | | |
|---|---|---|---|
| 2,874,063 | A | 2/1959 | Greig |
| 3,590,000 | A | 6/1971 | Palermiti et al. |
| 3,655,374 | A | 4/1972 | Palermiti et al. |
| 3,674,736 | A | 7/1972 | Lerman et al. |
| 3,720,617 | A | 3/1973 | Chatterji et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,394,430 | A | 7/1983 | Jadwin et al. |
| 4,560,635 | A | 12/1985 | Hoffend et al. |
| 4,797,339 | A | 1/1989 | Maruyama et al. |
| 4,935,326 | A | 6/1990 | Creatura et al. |
| 4,937,166 | A | 6/1990 | Creatura et al. |
| 4,983,488 | A | 1/1991 | Tan et al. |
| 4,996,127 | A | 2/1991 | Hasegawa et al. |
| 5,278,020 | A | 1/1994 | Grushkin et al. |
| 5,290,654 | A | 3/1994 | Sacripante et al. |

(Continued)

FOREIGN PATENT DOCUMENTS

EP 1 777 591 4/2007

OTHER PUBLICATIONS

European Search Report dated Jul. 14, 2009 for European Appln. No. EP 07 11 0188.

*Primary Examiner*—Hoa V Le
(74) *Attorney, Agent, or Firm*—Carter, DeLuca, Farrell & Schmidt, LLP

(57) ABSTRACT

A toner having a core with a first latex having a specific glass transition temperature, and further having a shell surrounding the core with a second latex having a specific glass transition temperature, and processes for producing the same.

10 Claims, 4 Drawing Sheets

U.S. PATENT DOCUMENTS 5,308,734 A 5/1994 Sacripante et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,403,693 A 4/1995 Patel et al.
5,405,728 A 4/1995 Hopper et al.
5,418,108 A 5/1995 Kmiecik-Lawrynowicz et al.
5,496,676 A 3/1996 Croucher et al.
5,501,935 A 3/1996 Patel et al.
5,527,658 A 6/1996 Hopper et al.
5,585,215 A 12/1996 Ong et al.
5,650,255 A 7/1997 Ng et al.
5,650,256 A 7/1997 Veregin et al.
5,853,943 A 12/1998 Cheng et al.
5,928,830 A 7/1999 Cheng et al.
6,004,714 A 12/1999 Ciccarelli et al.
6,190,815 B1 2/2001 Ciccarelli et al.
6,326,117 B1 12/2001 Ishlhara
6,805,481 B2 10/2004 Kumar et al.
6,841,329 B2 1/2005 Nguyen et al.
7,037,633 B2 5/2006 Hopper et al.
7,041,420 B2 5/2006 Vandewinckel et al.
7,049,042 B2 5/2006 Hopper et al.
7,052,818 B2 5/2006 Marcello et al.
2005/0136352 A1* 6/2005 Vandewinckel et al. .. 430/107.1
2005/0147912 A1* 7/2005 Takagi et al. ..... 430/120
2005/0175920 A1* 8/2005 Tsurumi et al. ..... 430/108.8
2005/0181289 A1* 8/2005 Yamazaki et al. ..... 430/47
2006/0003250 A1* 1/2006 Moudry et al. ..... 430/137.1
2006/0003251 A1* 1/2006 Chou et al. ..... 430/137.1
2006/0046178 A1* 3/2006 Akiyama et al. ..... 430/108.23
2006/0057484 A1* 3/2006 Tsurumi et al. ..... 430/108.8
2006/0088782 A1* 4/2006 Lee et al. ..... 430/137.11
2006/0105258 A1* 5/2006 Ishiyama et al. ..... 430/108.4
2006/0105263 A1* 5/2006 Moffat et al. ..... 430/110.2
2007/0092821 A1* 4/2007 Sato et al. ..... 430/108.4
2008/0044755 A1* 2/2008 Marcello et al. ..... 430/110.2
2008/0063966 A1* 3/2008 Mattison et al. ..... 430/108.7
2008/0138730 A1* 6/2008 Lai et al. ..... 430/105
2008/0138732 A1* 6/2008 Lai et al. ..... 430/109.3

* cited by examiner

TONER COMPOSITION

BACKGROUND

The present disclosure relates generally to toners and toner processes, and more specifically, to toner compositions, in embodiments, possessing excellent charging properties and dispensing performance.

Numerous processes are known for the preparation of toners, such as, for example, conventional processes wherein a resin is melt kneaded or extruded with a pigment, micronized and pulverized to provide toner particles. In addition, there are illustrated in U.S. Pat. Nos. 5,364,729 and 5,403,693, the disclosures of each of which are hereby incorporated by reference in their entirety, methods of preparing toner particles by blending together latexes with pigment particles. Also relevant are U.S. Pat. Nos. 4,996,127, 4,797,339 and 4,983,488, the disclosures of each of which are hereby incorporated by reference in their entirety.

Toner may also be made by an emulsion aggregation process. Methods of preparing an emulsion aggregation (EA) type toner are known and toners may be formed by aggregating a colorant with a latex polymer formed by batch or semi-continuous emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. In particular, the '943 patent describes a process including: (i) conducting a pre-reaction monomer emulsification which includes emulsification of the polymerization reagents of monomers, chain transfer agent, a disulfonate surfactant or surfactants, and optionally an initiator, wherein the emulsification is accomplished at a low temperature of, for example, from about 5° C. to about 40° C.; (ii) preparing a seed particle latex by aqueous emulsion polymerization of a mixture including (a) part of the monomer emulsion, from about 0.5 to about 50 percent by weight, or from about 3 to about 25 percent by weight, of the monomer emulsion prepared in (i), and (b) a free radical initiator, from about 0.5 to about 100 percent by weight, or from about 3 to about 100 percent by weight, of the total initiator used to prepare the latex polymer at a temperature of from about 35° C. to about 125° C., wherein the reaction of the free radical initiator and monomer produces the seed latex comprised of latex resin wherein the particles are stabilized by surfactants; (iii) heating and feed adding to the formed seed particles the remaining monomer emulsion, from about 50 to about 99.5 percent by weight, or from about 75 to about 97 percent by weight, of the monomer emulsion prepared in (ii), and optionally a free radical initiator, from about 0 to about 99.5 percent by weight, or from about 0 to about 97 percent by weight, of the total initiator used to prepare the latex polymer at a temperature from about 35° C. to about 125° C.; and (iv) retaining the above contents in the reactor at a temperature of from about 35° C. to about 125° C. for an effective time period to form the latex polymer, for example from about 0.5 to about 8 hours, or from about 1.5 to about 6 hours, followed by cooling. Other examples of emulsion/aggregation/coalescing processes for the preparation of toners are illustrated in U.S. Pat. Nos. 5,290,654, 5,278,020, 5,308,734, 5,370,963, 5,344,738, 5,403,693, 5,418,108, 5,364,729, and 5,346,797, the disclosures of each of which are hereby incorporated by reference in their entirety. Other processes are disclosed in U.S. Pat. Nos. 5,348,832, 5,405,728, 5,366,841, 5,496,676, 5,527,658, 5,585,215, 5,650,255, 5,650,256 and 5,501,935, the disclosures of each of which are hereby incorporated by reference in their entirety.

Toner systems normally fall into two classes: two component systems, in which the developer material includes magnetic carrier granules having toner particles adhering triboelectrically thereto; and single component systems, which typically use only toner. The operating latitude of a powder xerographic development system may be determined to a great degree by the ease with which toner particles may be supplied to an electrostatic image. Placing charge on the particles, to enable movement and development of images via electric fields, is most often accomplished with triboelectricity. Triboelectric charging may occur either by mixing the toner with larger carrier beads in a two component development system or by rubbing the toner between a blade and donor roll in a single component system.

In use, toners may clog the apparatus utilized to dispense the toner during the electrophotographic process. For example, if toner does not flow quickly enough into the developer housing, and more toner is dispensed, the toner starts to back up and the dispenser becomes packed and/or clogged with toner. When the dispenser becomes clogged, other mechanical components of an electrophotographic machine may begin to wear. In addition, the electrophotographic machine may issue a premature signal or message to the consumer that a new toner cartridge is required.

Toners may also undergo blocking during shipment. Blocking is a phenomenon where toner that has been subjected to a high temperature softens on its surface and the toner particles coagulate. As a result, the flowability of the toner in the developing unit of an electrophotographic apparatus radically drops, and clogging may occur upon use.

For example, some toners have a low blocking temperature due to the low glass transition temperature (Tg), about 49° C., of the latex resins utilized to form the toner. This low blocking temperature means the toner may become clogged or blocked during transportation in warm temperature climates, where the temperature of the environment may exceed the blocking temperature of the toner. In some cases, the toner may have to be shipped in refrigerated containers or may require the use of temperature sensor labels on toner cartridge shipments to avoid this blocking problem.

Hence, it would be advantageous to provide a toner composition with excellent charging characteristics and excellent dispensing performance.

SUMMARY

The present disclosure provides toners possessing a core including a first latex having a glass transition temperature from about 45° C. to about 54° C. and a shell surrounding said core including a second latex having a glass transition temperature from about 55° C. to about 65° C. Toners of the present disclosure may also include a colorant and additional additives such as surfactants, coagulants, surface additives, and mixtures thereof.

In embodiments, the toner may be an emulsion aggregation toner.

In embodiments, toners of the present disclosure may possess a gloss from about 20 GGU (Gardiner Gloss Units) to about 120 GGU.

The present disclosure also provides processes which include contacting a latex having a glass transition temperature from about 45° C. to about 54° C., an aqueous colorant dispersion, and a wax dispersion having a melting point of from about 70° C. to about 95° C. to form a blend, mixing the blend with a coagulant, heating the mixture to form toner aggregates, adding a second latex having a glass transition temperature from about 55° C. to about 65° C. to the toner aggregates wherein the second latex forms a shell over said toner aggregates, adding a base to increase the pH to a value of from about 4 to about 7, heating the toner aggregates with the shell above the glass transition temperature of the first latex and the second latex, and recovering a resulting toner.

In embodiments, the first latex utilized in the process may have a glass transition temperature from about 49° C. to about 53° C., the second latex may have a glass transition temperature from about 57° C. to about 61° C., the wax may have a melting point of from about 75° C. to about 93° C., and the coagulant may be a polyaluminum chloride or a polymetal silicate.

In embodiments, the process may also include adding an organic sequestering agent to the toner aggregates having a shell after adding the base. Suitable organic sequestering agents include, for example, organic acids, salts of organic acids, esters of organic acids, substituted pyranones, water soluble polymers including polyelectrolytes that contain both carboxylic acid and hydroxyl functionalities, and combinations thereof.

In embodiments, processes of the present disclosure include contacting a latex including styrene acrylates, styrene butadienes, styrene methacrylates, and combinations thereof having a glass transition temperature from about 45° C. to about 54° C., an aqueous colorant dispersion, and a wax dispersion having a melting point of from about 70° C. to about 85° C. to form a blend. The blend may be mixed with a coagulant and then the mixture may be heated to form toner aggregates. A second latex including styrene acrylates, styrene butadienes, styrene methacrylates, and combinations thereof having a glass transition temperature from about 55° C. to about 65° C. may be added to the toner aggregates, where the second latex forms a shell over said toner aggregates. A base may be added to increase the pH to a value of from about 4 to about 7, and the toner aggregates with the shell may be heated to above the glass transition temperature of the first latex and the second latex. An organic sequestering agent selected from the group consisting of organic acids, salts of organic acids, esters of organic acids, substituted pyranones, polyelectrolytes possessing carboxylic acid and hydroxyl functionalities, and combinations thereof may be added, and a resulting toner may be recovered.

In embodiments, suitable organic sequestering agents include ethylene diamine tetra acetic acid, L-glutamic acid in combination with N,N diacetic acid, humic acid, fulvic acid, peta-acetic acid, tetra-acetic acid, salts of methylglycine diacetic acid, salts of ethylenediamine disuccinic acid, sodium gluconate, magnesium gluconate, potassium gluconate, potassium citrate, sodium citrate, nitrotriacetate salt, maltol, ethyl-maltol, and combinations thereof.

Developer compositions are also provided including toners of the present disclosure and a carrier.

BRIEF DESCRIPTION OF THE DRAWINGS

Various embodiments of the present disclosure will be described herein below with reference to the figures wherein.

DETAILED DESCRIPTION

Figure 1A:
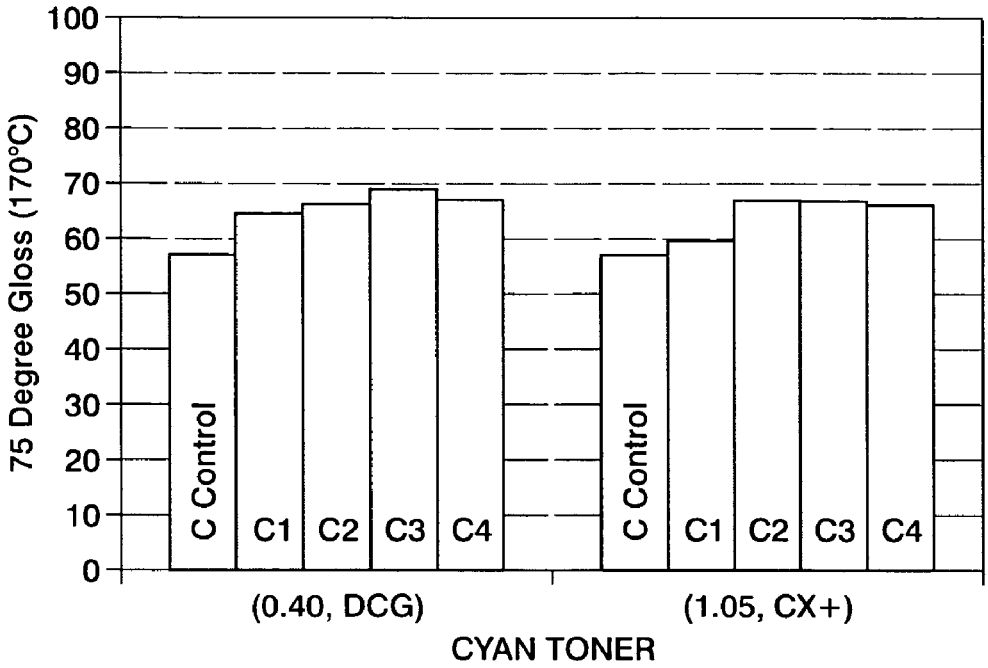
FIG. 1A is a graph depicting the degree gloss of cyan toners of the present disclosure with a control toner.

In accordance with the present disclosure, toner compositions and methods for producing toners are provided which result in toner having excellent charging characteristics and flow characteristics. The excellent flow characteristics of the resulting toners reduce the incidence of clogging failure from a dispenser component of an electrophotographic system compared with conventionally produced toners. Toners of the present disclosure may also be utilized to produce images having excellent gloss characteristics. Toners of the present disclosure may also have blocking temperatures that are higher compared with conventional toners.

Blocking temperature includes, in embodiments, for example, the temperature at which caking or agglomeration occurs for a given toner composition.

In embodiments, the toners may be an emulsion aggregation type toner prepared by the aggregation and fusion of latex resin particles and waxes with a colorant, and optionally one or more additives such as surfactants, coagulants, surface additives, and mixtures thereof. In embodiments, one or more may be from about one to about twenty, and in embodiments from about three to about ten.

In embodiments, the latex may have a glass transition temperature of from about 54° C. and about 65° C., and in embodiments, of from about 55° C. to 61° C. In embodiments, the latex may include submicron particles having a size of, for example, from about 50 to about 500 nanometers, in embodiments from about 100 to about 400 nanometers in volume average diameter as determined, for example, by a Brookhaven nanosize particle analyzer. The latex resin may be present in the toner composition in an amount from about 75 weight percent to about 98 weight percent, and in embodiments from about 80 weight percent to about 95 weight percent of the toner or the solids of the toner. The expression solids can refer, in embodiments, for example, to the latex, colorant, wax, and any other optional additives of the toner composition.

In embodiments of the present disclosure, the resin in the latex may be derived from the emulsion polymerization of monomers including, but not limited to, styrenes, butadienes, isoprenes, acrylates, methacrylates, acrylonitriles, acrylic acid, methacrylic acid, itaconic or beta carboxy ethyl acrylate (β-CEA) and the like.

In embodiments, the resin of the latex may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly (styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and mixtures thereof. In embodiments, the polymer is poly (styrene/butyl acrylate/beta carboxylethyl acrylate). The polymer may be block, random, or alternating copolymers.

In embodiments, the latex may be prepared by a batch or a semicontinuous polymerization resulting in submicron non-crosslinked resin particles suspended in an aqueous phase containing a surfactant. Surfactants which may be utilized in the latex dispersion can be ionic or nonionic surfactants in an amount of from about 0.01 to about 15, and in embodiments of from about 0.01 to about 5 weight percent of the solids.

Anionic surfactants which may be utilized include sulfates and sulfonates such as sodium dodecylsulfate (SDS), sodium dodecyl benzene sulfonate, sodium dodecylnaphthalene sulfate, dialkyl benzenealkyl sulfates and sulfonates, abitic acid, and the NEOGEN brand of anionic surfactants. In embodiments suitable anionic surfactants include NEOGEN RK available from Daiichi Kogyo Seiyaku Co. Ltd., or TAYCA POWER BN2060 from Tayca Corporation (Japan), which are branched sodium dodecyl benzene sulfonates.

Examples of cationic surfactants include ammoniums such as dialkyl benzene alkyl ammonium chloride, lauryl trimethyl ammonium chloride, alkylbenzyl methyl ammonium chloride, alkyl benzyl dimethyl ammonium bromide, benzalkonium chloride, $C_{12}$, $C_{15}$, $C_{17}$ trimethyl ammonium bromides, mixtures thereof, and the like. Other cationic surfactants include cetyl pyridinium bromide, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. In embodiments a suitable cationic surfactant includes SANISOL B-50 available from Kao Corp., which is primarily a benzyl dimethyl alkonium chloride.

Exemplary nonionic surfactants include alcohols, acids, celluloses and ethers, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy) ethanol available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. In embodiments a suitable nonionic surfactant is ANTAROX 897 available from Rhone-Poulenc Inc., which is primarily an alkyl phenol ethoxylate.

In embodiments, the resin of the latex may be prepared with initiators, such as water soluble initiators and organic soluble initiators. Exemplary water soluble initiators include ammonium and potassium persulfates which can be added in suitable amounts, such as from about 0.1 to about 8 weight percent, and in embodiments of from about 0.2 to about 5 weight percent of the monomer. Examples of organic soluble initiators include Vazo peroxides, such as VAZO 64™, 2-methyl 2-2'-azobis propanenitrile, VAZO 88™, 2-2'-azobis isobutyramide dehydrate, and mixtures thereof. Initiators can be added in suitable amounts, such as from about 0.1 to about 8 weight percent, and in embodiments of from about 0.2 to about 5 weight percent of the monomers.

Known chain transfer agents can also be utilized to control the molecular weight properties of the resin if prepared by emulsion polymerization. Examples of chain transfer agents include dodecane thiol, dodecylmercaptan, octane thiol, carbon tetrabromide, carbon tetrachloride and the like in various suitable amounts, such as from about 0.1 to about 20 percent, and in embodiments of from about 0.2 to about 10 percent by weight of the monomer.

Other processes for obtaining resin particles include those produced by a polymer microsuspension process as disclosed in U.S. Pat. No. 3,674,736, the disclosure of which is hereby incorporated by reference in its entirety, a polymer solution microsuspension process as disclosed in U.S. Pat. No. 5,290,654, the disclosure of which is hereby incorporated by reference in its entirety, and mechanical grinding processes, or other processes within the purview of those skilled in the art.

In embodiments, the resin of the latex may be non-crosslinked; in other embodiments, the resin of the latex may be a crosslinked polymer; in yet other embodiments, the resin may be a combination of a non-crosslinked and a crosslinked polymer. Where crosslinked, a crosslinker, such as divinyl benzene or other divinyl aromatic or divinyl acrylate or methacrylate monomers may be used in the crosslinked resin. The crosslinker may be present in an amount of from about 0.01 percent by weight to about 25 percent by weight, and in embodiments of from about 0.5 to about 15 percent by weight of the crosslinked resin.

Where present, crosslinked resin particles may be present in an amount of from about 0.1 to about 50 percent by weight, and in embodiments of from about 1 to about 20 percent by weight of the toner.

The latex may then be added to a colorant dispersion. The colorant dispersion may include, for example, submicron colorant particles having a size of, for example, from about 50 to about 500 nanometers, and in embodiments of from about 100 to about 400 nanometers in volume average diameter. The colorant particles may be suspended in an aqueous water phase containing an anionic surfactant, a nonionic surfactant, or mixtures thereof. In embodiments, the surfactant may be ionic and from about 1 to about 25 percent by weight, in embodiments from about 4 to about 15 percent by weight of the colorant.

Colorants include pigments, dyes, mixtures of pigments and dyes, mixtures of pigments, mixtures of dyes, and the like. The colorant may be, for example, carbon black, cyan, yellow, magenta, red, orange, brown, green, blue, violet or mixtures thereof.

In embodiments wherein the colorant is a pigment, the pigment may be, for example, carbon black, phthalocyanines, quinacridones or RHODAMINE B™ type, red, green, orange, brown, violet, yellow, fluorescent colorants and the like.

The colorant may be present in the toner of the disclosure in an amount of from about 1 to about 25 percent by weight of toner, in embodiments in an amount of from about 2 to about 15 percent by weight of the toner.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP-608™; Magnox magnetites including TMB-100™, or TMB-104 ™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido) phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 3 to about 12 weight percent of the toner.

The toner compositions of the present disclosure may further include a wax with a melting point of from about 70° C. to about 95° C., and in embodiments of from about 75° C. to about 93° C. The wax enables toner cohesion and prevents the formation of toner aggregates. In embodiments, the wax may be in a dispersion. Wax dispersions suitable for use in forming toners of the present disclosure include, for example, submicron wax particles having a size of from about 50 to about 500 nanometers, in embodiments of from about 100 to about 400 nanometers in volume average diameter. The wax particles may be suspended in an aqueous phase of water and an ionic surfactant, nonionic surfactant, or mixtures thereof. The ionic surfactant or nonionic surfactant may be present in an amount of from about 0.5 to about 10 percent by weight, and in embodiments of from about 1 to about 5 percent by weight of the wax.

The wax dispersion according to embodiments of the present disclosure may include any suitable wax such as a natural vegetable wax, natural animal wax, mineral wax and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes include, for example, Fischer-Tropsch wax, acrylate wax, fatty acid amide wax, silicone wax, polytetrafluoroethylene wax, polyethylene wax, polypropylene wax, and mixtures thereof. In embodiments, the wax may be a modified wax such as a montan wax derivative, paraffin wax derivative, and/or microcrystalline wax derivative, and combinations thereof.

Examples of polypropylene and polyethylene waxes include those commercially available from Allied Chemical and Baker Petrolite, wax emulsions available from Michelman Inc. and the Daniels Products Company, EPOLENE N-15 commercially available from Eastman Chemical Products, Inc., Viscol 550-P, a low weight average molecular weight polypropylene available from Sanyo Kasel K.K., and similar materials. In embodiments, suitable commercially available polyethylene waxes possess a molecular weight (Mw) of from about 1,000 to about 1,500, and in embodiments of from about 1,250 to about 1,400, while suitable commercially available polypropylene waxes may possess a molecular weight of from about 4,000 to about 5,000, and in embodiments of from about 4,250 to about 4,750.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, Joncryl 74, 89, 130, 537, and 538, all available from Johnson Diversey, Inc, or chlorinated polypropylenes and polyethylenes commercially available from Allied Chemical and Petrolite Corporation and Johnson Diversey, Inc.

The wax may be present in an amount of from about 1 to about 30 percent by weight, in embodiments from about 2 to about 20 percent by weight of the toner. In some embodiments, where a polyethylene wax is used, the wax may be present in an amount of from about 8 to about 14 percent by weight, in embodiments from about 10 to about 12 percent by weight of the toner.

The resultant blend of latex dispersion, colorant dispersion, and wax dispersion may be stirred and heated to a temperature of from about 45° C. to about 65° C., in embodiments of from about 48° C. to about 63° C., resulting in toner aggregates of from about 4 microns to about 8 microns in volume average diameter, and in embodiments of from about 5 microns to about 7 microns in volume average diameter.

In embodiments, a coagulant may be added during or prior to aggregating the latex, the aqueous colorant dispersion, and the wax dispersion. The coagulant may be added over a period of time from about 1 to about 5 minutes, in embodiments from about 1.25 to about 3 minutes.

Examples of coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to be of the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.02 to about 0.3 percent by weight of the toner, and in embodiments from about 0.05 to about 0.2 percent by weight of the toner.

Optionally a second latex can be added to the aggregated particles. The second latex may include, for example, submicron non-crosslinked resin particles. Any resin described above as suitable for the latex may be utilized as the core or shell. The second latex may be added in an amount of from about 10 to about 40 percent by weight of the initial latex, in embodiments of from about 15 to about 30 percent by weight of the initial latex, to form a shell or coating on the toner aggregates. The thickness of the shell or coating may be from about 200 to about 800 nanometers, and in embodiments from about 250 to about 750 nanometers. In embodiments, the latex utilized for the core and shell may be the same resin; in other embodiments, the latex utilized for the core and shell may be different resins.

In embodiments the latex utilized to form the shell may have a glass transition temperature (Tg) greater than the glass transition temperature of the latex utilized to form the core. In embodiments, the Tg of the shell latex may be from about 55° C. to about 65° C., in embodiments from about 57° C. to about 61° C., while the Tg of the core latex may be from about 45° C. to about 54° C., in embodiments from about 49° C. to about 53° C. In some embodiments, the latex may be a styrene/butyl acrylate copolymer. As noted above, in embodiments the Tg of the latex utilized to form the core may be lower than the Tg of the latex utilized to form the shell. For example, in embodiments, a styrene/butyl acrylate copolymer having a Tg from about 45° C. to about 54° C., in embodiments from about 49° C. to about 53° C., may be utilized to form the core, while a styrene/butyl acrylate copolymer having a Tg from about 55° C. to about 65° C., in embodiments from about 57° C. to about 61° C. may be utilized to form the shell.

Similarly, while the latexes utilized to form the core and shell may be the same, the amounts of the various monomers may vary. Thus, in embodiments, the resin for the core of a toner particle may include a styrene/butyl acrylate copolymer having from about 70% by weight to about 78% by weight styrene, and from about 22% by weight to about 30% by weight butyl acrylate, in embodiments from about 74% by weight to about 77% by weight styrene, and from about 21% to about 25% by weight butyl acrylate. At the same time, a styrene/butyl acrylate copolymer utilized to form the shell of a toner particle may include a styrene/butyl acrylate copolymer having from about 79% by weight to about 85% by weight styrene, and from about 15% by weight to about 21% by weight butyl acrylate, in embodiments from about 81% by weight to about 83% by weight styrene, and from about 17% to about 19% by weight butyl acrylate.

Once the desired final size of the particles is achieved with a volume average diameter of from about 4 microns to about 9 microns, and in embodiments of from about 5.6 microns to about 8 microns, the pH of the mixture may be adjusted with a base to a value of from about 4 to about 7, and in embodiments from about 6 to about 6.8. Any suitable base may be used such as, for example, alkali metal hydroxides such as, for example, sodium hydroxide, potassium hydroxide, and ammonium hydroxide. The alkali metal hydroxide may be added in amounts from about 6 to about 25 percent by weight of the mixture, in embodiments from about 10 to about 20 percent by weight of the mixture.

After adjustment of the pH, in embodiments an organic sequestering agent may be added to the mixture. Such sequestering agents and their use in forming toners are described, for example, in U.S. Pat. No. 7,037,633, the disclosure of which is hereby incorporated by reference in its entirety. In embodiments, suitable organic sequestering agents include, for example, organic acids such as ethylene diamine tetra acetic acid (EDTA), GLDA (commercially available L-glutamic acid N,N diacetic acid) humic and fulvic acids, peta-acetic and tetra-acetic acids; salts of organic acids including salts of methylglycine diacetic acid (MGDA), and salts of ethylenediamine disuccinic acid (EDDS); esters of organic acids including sodium gluconate, magnesium gluconate, potassium gluconate, potassium and sodium citrate, nitrotriacetate (NTA) salt; substituted pyranones including maltol and ethylmaltol; water soluble polymers including polyelectrolytes that contain both carboxylic acid (COOH) and hydroxyl (OH) functionalities; and combinations thereof. Examples of specific sequestering agents include

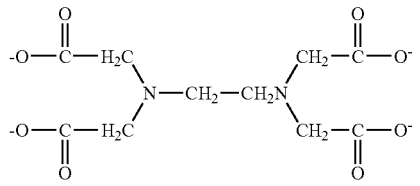

EDTA

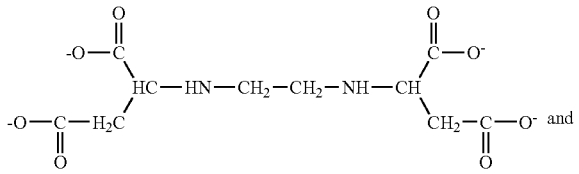

EDDS

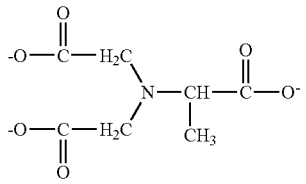

MGDA

In embodiments, EDTA, a salt of methylglycine diacetic acid (MGDA), or a salt of ethylenediamine disuccinic acid (EDDS), may be utilized as a sequestering agent.

The amount of sequestering agent added may be from about 0.25 pph to about 4 pph, in embodiments from about 0.5 pph to about 2 pph. The sequestering agent complexes or chelates with the coagulant metal ion, such as aluminum, thereby extracting the metal ion from the toner aggregate particles. The amount of metal ion extracted may be varied with the amount of sequestering agent, thereby providing controlled crosslinking. For example, in embodiments, adding about 0.5 pph of the sequestering agent (such as EDTA) by weight of toner, may extract from about 40 to about 60 percent of the aluminum ions, while the use of about 1 pph of the sequestering agent (such as EDTA) may result in the extraction of from about 95 to about 100 percent of the aluminum.

The mixture is then heated above the glass transition temperature of the latex utilized to form the core and the latex utilized to form the shell. The temperature the mixture is heated to will depend upon the resin utilized but may, in embodiments, be from about 48° C. to about 98° C., in embodiments from about 55° C. to about 95° C. Heating may occur for a period of time from about 20 minutes to about 3.5 hours, in embodiments from about 1.5 hours to about 2.5 hours.

The pH of the mixture is then lowered to from about 3.5 to about 6 and, in embodiments, to from about 3.7 to about 5.5 with, for example, an acid to coalesce the toner aggregates and modify the shape. Suitable acids include, for example, nitric acid, sulfuric acid, hydrochloric acid, citric acid and/or acetic acid. The amount of acid added may be from about 4 to about 30 percent by weight of the mixture, and in embodiments from about 5 to about 15 percent by weight of the mixture.

The mixture is subsequently coalesced. Coalescing may include stirring and heating at a temperature of from about 90° C. to about 99° C., for a period of from about 0.5 to about 6 hours, and in embodiments from about 2 to about 5 hours. Coalescing may be accelerated by additional stirring during this period of time.

The mixture is cooled, washed and dried. Cooling may be at a temperature of from about 20° C. to about 40° C., in embodiments from about 22° C. to about 30° C. over a period time from about 1 hour to about 8 hours, and in embodiments from about 1.5 hours to about 5 hours.

In embodiments, cooling a coalesced toner slurry includes quenching by adding a cooling media such as, for example, ice, dry ice and the like, to effect rapid cooling to a temperature of from about 20° C. to about 40° C., and in embodiments of from about 22° C. to about 30° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture may not be feasible or practical, neither by the introduction of a cooling medium into the toner mixture, nor by the use of jacketed reactor cooling.

The washing may be carried out at a pH of from about 7 to about 12, and in embodiments at a pH of from about 9 to about 11. The washing may be at a temperature of from about 45° C. to about 70° C., and in embodiments from about 50° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying is typically carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

An emulsion aggregation toner of the present disclosure may have particles with a circularity of from about 0.93 to about 0.99, and in embodiments of from about 0.94 to about 0.98. When the spherical toner particles have a circularity in this range, the spherical toner particles remaining on the surface of the image holding member pass between the contacting portions of the imaging holding member and the contact charger, the amount of deformed toner is small, and therefore generation of toner filming can be prevented so that a stable image quality without defects can be obtained over a long period.

The melt flow index (MFI) of toners produced in accordance with the present disclosure may be determined by methods within the purview of those skilled in the art, including the use of a plastometer. For example, the MFI of the toner may be measured on a Tinius Olsen extrusion plastometer at about 125° C. with about 5 kilograms load force. Samples may then be dispensed into the heated barrel of the melt indexer, equilibrated for an appropriate time, in embodiments from about five minutes to about seven minutes, and then the load force of about 5 kg may be applied to the melt indexer's piston. The applied load on the piston forces the molten sample out a predetermined orifice opening. The time for the test may be determined when the piston traveled one inch. The melt flow may be calculated by the use of the time, distance, and weight volume extracted during the testing procedure.

MFI as used herein thus includes, in embodiments, for example, the weight of a toner (in grams) which passes through an orifice of length L and diameter D in a 10 minute period with a specified applied load (as noted above, 5 kg). An MFI unit of 1 thus indicates that only 1 gram of the toner passed through the orifice under the specified conditions in 10 minutes time. "MFI units" as used herein thus refers to units of grams per 10 minutes.

Toners of the present disclosure subjected to this procedure may have varying MFI depending on the pigment utilized to form the toner. In embodiments, a black toner of the present disclosure may have an MFI from about 30 gm/10 minutes to about 50 gm/10 minutes, in embodiments from about 36 gm/10 minutes to about 47 gm/10 minutes; a cyan toner may have an MFI from about 30 gm/10 minutes to about 50 gm/10 minutes, in embodiments from about 36 gm/10 minutes to about 46 gm/10 minutes; a yellow toner may have an MFI from about 12 gm/10 minutes to about 55 gm/10 minutes, in embodiments from about 16 gm/10 minutes to about 50 gm/10 minutes; and a magenta toner may have an MFI of from about 45 gm/10 minutes to about 55 gm/10 minutes, in embodiments from about 48 gm/10 minutes to about 52 gm/10 minutes.

The toners of the present disclosure may be produced economically utilizing a simple manufacturing process. Use of a latex resin having a high Tg as the shell will result in a higher blocking temperature, in embodiments about 5° C. higher, compared with other conventional toners. This higher blocking temperature improves the stability of the toners during transportation and storage, especially in warmer climates. The blocking temperature of a toner of the present disclosure may be from about 51° C. to about 58° C., in embodiments from about 53° C. to about 56° C.

The toner may also include any known charge additives in amounts of from about 0.1 to about 10 weight percent, and in embodiments of from about 0.5 to about 7 weight percent of the toner. Examples of such charge additives include alkyl pyridinium halides, bisulfates, the charge control additives of U.S. Pat. Nos. 3,944,493, 4,007,293, 4,079,014, 4,394,430 and 4,560,635, the disclosures of each of which are hereby incorporated by reference in their entirety, negative charge enhancing additives like aluminum complexes, and the like.

Surface additives can be added to the toner compositions of the present disclosure after washing or drying. Examples of such surface additives include, for example, metal salts, metal salts of fatty acids, colloidal silicas, metal oxides, strontium titanates, mixtures thereof, and the like. Surface additives may be present in an amount of from about 0.1 to about 10 weight percent, and in embodiments of from about 0.5 to about 7 weight percent of the toner. Examples of such additives include those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be present in an amount of from about 0.05 to about 5 percent, and in embodiments of from about 0.1 to about 2 percent of the toner, which additives can be added during the aggregation or blended into the formed toner product.

In embodiments, additives may be added to toner particles of the present disclosure and mixed, such as by conventional blending. The mixing process by which the toner may be combined with surface additives may, in embodiments, be both a low energy and low intensity process. This mixing process can include, but is not limited to, tumble blending, blending with Henschel mixers (sometimes referred to as Henschel blending), agitation using a paint style mixer, and the like. Effective mixing can also be accomplished within the toner cartridge/bottle by shaking by hand.

In embodiments, mixing may occur by the use of blenders, such as a Henschel 600L, Henschel 75L, Henschel 10L, and the like. While the exact blending parameters will vary depending upon the composition of the toner utilized, that is, the latex resin, pigment, additive package, and the like, in embodiments, for cyan, yellow, and black toners, blending with a specific energy of from about 1 W-hr/lb to about 15 W-hr/lb, in embodiments from about 3 W-hr/lb to about 10 W-hr/lb, may produce desired additive attachment. Use of blending at low speeds, in embodiments for a short period of time, from about 3 minutes to about 10 minutes, in embodiments from about 5 minutes to about 8 minutes, may result in lower amounts of additive attachment compared with conventional toners. The additives that are attached are loosely attached, which may enhance the attachment of additives at the surface of the latex resin and not incorporation therein. This enhanced surface attachment may result in toners possessing excellent flow and less clogging from dispensers utilized in electrophotography apparatus, as compared with conventional toners.

Methods for determining the extent of surface additive attachment are within the purview of those skilled in the art. In embodiments, the extent of surface additive attachment may be determined by subjecting the toner particles to energy, such as sonication, and determining how much of a surface additive, such as $SiO_2$, remains attached after the exposure to energy. For example, for toners of the present disclosure, after about 3 KJ of sonication energy is applied to a toner herein, less than about 65% SiO2 remains on the toner particles; after about 12 KJ of sonication energy is applied to a toner herein, less than about 25% of SiO2 remains on the toner.

The basic flow energy (BFE) of a toner may also be determined. The axial forces and rotational forces acting on the blade of a blender may be measured continuously and used to derive the work done, or energy consumed, in displacing the toner. This is the basic flow energy (BFE). The BFE is a benchmark measurement of the rheology of the toner when in a conditioned state. Toners of the present disclosure may also have a basic flow energy that is less than about 75 mJ, in embodiments from about 45 mJ to about 75 mJ, in embodiments from about 50 mJ to about 70 mJ. These toner attributes may help ensure that customers will not experience gross dispense clogging failure using high toner demand (single color), low developer housing process speed, and high duty cycle modes (about 52 mm/sec).

Toners of the present disclosure may have a triboelectric charge at from about 35 μC/g to about 65 μC/g, in embodiments from about 45 μC/g to about 55 μC/g.

Toner in accordance with the present disclosure can be used in a variety of imaging devices including printers, copy machines, and the like. The toners generated in accordance with the present disclosure are excellent for imaging processes, especially xerographic processes, which may operate with a toner transfer efficiency in excess of about 90 percent, such as those with a compact machine design without a cleaner or those that are designed to provide high quality colored images with excellent image resolution, acceptable signal-to-noise ratio, and image uniformity. Further, toners of the present disclosure can be selected for electrophotographic imaging and printing processes such as digital imaging systems and processes.

Images produced with such toners may thus have desirable gloss properties. Methods for determining gloss are within the purview of those skilled in the art and include, for example, the use of a Gardner Gloss Meter, which provides gloss measurements in Gardiner Gloss Units (GGU). For example, in embodiments, a Gardiner Gloss Meter may be utilized to determine gloss using a 75° angle at a toner mass per area (TMA) of about 1.05, and at a temperature of about 160° C. Toners of the present disclosure may possess a gloss of from about 20 GGU to about 120 GGU, in embodiments from about 40 GGU to about 80 GGU. In embodiments, a gloss of from about 40 to about 60 GGU may be obtained where about 0.5 pph of a sequestering agent such as EDTA is used, and a gloss of about 60 to about 80 GGU may be obtained where about 1 pph of a sequestering agent such as EDTA is used.

The imaging process includes the generation of an image in an electronic printing apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material referred to in the art as "toner". The toner will normally be attracted to the discharged areas of the layer, thereby forming a toner image corresponding to the latent electrostatic image. This powder image may then be transferred to a support surface such as paper. The transferred image may subsequently be permanently affixed to the support surface as by heat.

Developer compositions can be prepared by mixing the toners obtained with the embodiments of the present disclosure with known carrier particles, including coated carriers, such as steel, ferrites, and the like. See, for example, U.S. Pat.

Nos. 4,937,166 and 4,935,326, the disclosures of each of which are hereby incorporated by reference in their entirety. The toner-to-carrier mass ratio of such developers may be from about 2 to about 20 percent, and in embodiments from about 2.5 to about 5 percent of the developer composition. The carrier particles can include a core with a polymer coating thereover, such as polymethylmethacrylate (PMMA), having dispersed therein a conductive component like conductive carbon black. Carrier coatings include silicone resins, fluoropolymers, mixtures of resins not in close proximity in the triboelectric series, thermosetting resins, and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

Development may be accomplished by a magnetic brush development process as disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer comprises conductive carrier particles and is capable of conducting an electric current between the biased magnet through the carrier particles to the photoreceptor.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLES

Example 1

A toner of the present disclosure was prepared by emulsion aggregation methods. Briefly, the toner was prepared as follows. 3000 kg of a styrene/butyl acrylate resin, with 800 kg of a pigment(s), 7000 kg of de-ionozed water, and 50 kg of flocculent were homogenized and mixed in a reactor for 1.0-2.5 hours. The batch was then heated, while continually being mixed, from about 25° C. to about 47° C. (below the Tg of the resin), allowing for the particle aggregate mixture to grow. Once the aggregate achieved a particle size of 4.2 microns to 4.8 microns, 1800 kg of a styrene/butyl acrylate resin was added as a shell, where the particle aggregate continued to grow till desired particle size of 5.2 microns-5.8 microns was achieved. Once the desired particle size was achieved, 100 kg of caustic with 60 kg of Versene was added, to the reaction, and the temperature was then raised from about 47° C. to about 95° C., where the shape of the particle began to spherodize above the Tg of the resin. Once the batch reached the coalescence temperature of about 95° C., the batch was held for 2.0-4.0 hours until the toner targeted circularity of 0.950-0.970 was achieved. The batch was then cooled from about 95° C. to about 40° C., where upon cooling, 300 kg-400 kg of acid was added in order to desorb the grafted surfactant molecules on the particle surface. Once cooled, the mixture was then transferred and screened through vibratory sieves, removing coarse. Once screened, the slurry was then washed and dried using a filter press followed by centrifugal drying.

The resulting toner possessed a styrene/butyl acrylate copolymer core of about 76.5 weight percent styrene and about 23.5 weight percent butyl acrylate, having a Tg of from about 49° C. to about 53° C. The resulting toner also possessed a styrene/butyl acrylate copolymer shell of about 81.7 weight percent styrene and about 18.3 weight percent butyl acrylate, having a Tg of from about 57° C. to about 61° C. The size of the resulting core/shell particles was from about 190 nm to about 220 nm and the molecular weight of the core/shell particles was from about 33 kpse to about 37 kpse.

An emulsion aggregation toner from FujiXerox was utilized as a control. This toner also had a core/shell construction, but both the core and shell included a styrene/butyl acrylate copolymer having about 76.5 weight percent styrene and about 23.5 weight percent butyl acrylate. The Tg of the copolymer utilized to form both the core and shell was from about 47° C. to about 51° C. The size of the resulting core/shell particles was from about 180 nm to about 250 nm and the molecular weight of the core/shell particles was from about 32.7 kpse to about 36.5 kpse.

The toner of the present disclosure possessed from about 10 to about 12 weight percent of LX-1508 polyethylene wax from Baker Petrolite; the control toner had from about 6 to about 8 weight percent of FNP0090 wax from Nippon Seiro. About 0.94 pph EDTA was added to the toner of the present disclosure as a flocculant; the control toner utilized about 7% of SNOWTEX OL/OS colloidal silica. PAC was utilized as a flocculant in the toner of the present disclosure; about 0.18 pph was utilized for each color. For the control, about 0.12 PAC was used for black, about 0.14 PAC was used for magenta, about 0.15 PAC was used for yellow, and about 0.145 PAC was used for cyan.

Pigments were added to both the toner of the present disclosure and the control toner to produce various colors. The pigment binder ratio for each color was about 15:3. Black was prepared by adding about 6% R330 pigment from Cabot Corp.; cyan was prepared by adding about 5% of PB15:3 pigment from Sun Chemical; yellow was prepared by adding about 6% of Y74 pigment from Clariant Corporation; and magenta was prepared by adding about 8% of PR238/122 from Sun Chemical.

As is apparent from the above, the toner of the present disclosure possessed a different shell latex (ratio of styrene to butyl acrylate) with a higher Tg range, to allow for a higher toner blocking temperature. Other differences included the use of the higher loading polyethylene wax from Baker Petrolite for equivalent release, use of EDTA to sequester the aluminum instead of the more expensive and more process cumbersome SNOWTEX OS/OL, and higher PAC content in the toner of the present disclosure than the control.

Various properties of both the toner and control toner were obtained utilizing methods within the purview of those skilled in the art. The primary and supplemental properties of the toners are set forth in Tables 1 and 2 below, respectively.

TABLE 1

| Particle Primary Properties | Control (Measured Reference/Quoted Specification) | Cyan 1 Range | Black 1 Range | Magenta 1 Range | Yellow 1 Range |
|---|---|---|---|---|---|
| Vol. Median Diameter (D50) | 5.6 ± 0.4 | 5.2-6 | 5.2-6 | 5.2-6 | 5.2-6 |
| Upper Vol. GSD (Particle Size Distribution) (D84/D50) | <1.23 | <1.23 | <1.23 | <1.23 | <1.23 |
| Lower No. GSD (D50/D16) | <1.3 | <1.3 | <1.3 | <1.3 | <1.3 |
| Circularity | 0.956-0.97 | 0.956-0.97 | 0.956-0.97 | 0.956-0.97 | 0.956-0.97 |
| Pigment Content (%) PB 15:3 (Cyan) | 5-5.3 | 4.5-5.5 | NA | NA | NA |
| Pigment Content (%) R330/PB15:3 (Black) | 7.3-7.5/1 | NA | 7.5-8.5 | NA | NA |
| Pigment Content (%) Y74 (Yellow) | 6.6-6.7 | NA | NA | NA | 5.5-6.5 |
| Pigment Content (%) PR238/PR122 (Magenta) | 4.4-4.5/4.4-4.5 | NA | NA | 3.8-4.8/3.8-4.8 | NA |
| Bulk Wax | 6-8 | 10-12 | 10-12 | 10-12 | 10-12 |
| Moisture Content (%) | ≦0.7 | ≦0.7 | ≦0.7 | ≦0.7 | ≦0.7 |

TABLE 2

| Particle Supplemental Properties | Black 1 | Cyan 1 | Yellow 1 | Magenta 1 |
|---|---|---|---|---|
| Melt Flow Index (125° C./5 kg) | 36-46.7 | 36-45.5 | 16-27.9 | 50.7 |
| Melt Flow Index (125° C./5 kg) | 18-20.2 | 16.3-19.1 | 16-27.9 | 50.7 |
| G' @ 120° C. (Pa) 10 radian/sec | 4797-6210 | 2846-4732 | 4,753-7184 | 4797 |
| G'' @ 120° C. (Pa) 10 radian/sec | 10220-12820 | 6191-9863 | 10440-13410 | 10220 |
| Vol. Coarse Content (12.7-39.24) | 0.42-0.58 | 0.02-1.04 | 0.01-.085 | 0.91-1.95 |
| No. % Fines (<4 mm) | 1.59-3.66 | 1.46-1.83 | 1.71-2.33 | 16.59-19 |
| Parent Tribo (B-zone) | 34.12-50.5 | 66.67-74.56 | 55.49-80.41 | 3.16-3.76 |
| Tg (onset) | 49.5-50.5 | 49.2-50.6 | 49.9-50.4 | 62.68 |
| Mw | 31.2-32 | 31.4-32.6 | 31.3-32.1 | 33.1 |
| Mn | 7.3-8.6 | 9.3-10.7 | 9.1-12.8 | 14.5 |
| Mp | 23.6-26.8 | 23.6-27.5 | 23.6-26.8 | 27.5 |
| MWD | 3.6-4.4 | 3-3.1 | 2.5-3.5 | 2.3 |
| Surface Properties | DONE | DONE | DONE | DONE |
| Surface Properties | G5 | G4 | G2-G5 | G5 |
| Surface Properties | G2-G3 | G2-G3 | G2-G3 | G3-G4 |
| Residual Surf. (Dowfax2A1) (μg/g) | 189-213 | 182-220 | 212-251 | 213 |
| Residual Surf. (Tayca) (μg/g) | 2830-3375 | 2553-2623 | 2708-4252 | 3375 |
| Residual Styrene (μg/g) | 18-81 | 16-17 | 22-28 | 44-81 |
| Residual Butly Acrylate (μg/g) | 150-170 | 150-170 | 130-170 | 130-170 |
| Residual Cumene (μg/g) | 17-20 | 18-23 | 16-23 | 20-23 |
| Ca Content (μg/g) | 16-23 | 2-8 | 8-11 | 8-10 |
| Cu Content (μg/g) | 1011-1041 | 5010-5058 | ND | 1011 |
| Fe Content (μg/g) | 1-4 | 2-7 | 6-11 | 1-4 |
| Na Content (μg/g) | 389-422 | 497-536 | 357-372 | 422 |
| Al Content (μg/g)/PAC (%) | 284-308 | 293-324 | 260-328 | 308 |
| BET multi point $m^2/g$ | 1.3-1.37 | 1.33-1.34 | 1.22-1.35 | 1.37 |
| BET single point $m^2/g$ | 1.23-1.3 | 1.26-1.27 | 1.16-1.27 | 1.3 |
| At % Oxygen | 6-9 | 6-9 | 6-9 | 6-9 |

Example 2

A toner additive package was prepared for toners of the present disclosure and a control toner from FujiXerox as described above in Example 1. Table 3 below includes a description of the additive formulation for the toner of the present disclosure and the control toner. As can be seen in Table 3 below, the black, cyan, and yellow toners of the present disclosure (black 1, cyan 1, and yellow 1) had the same toner additive formulation as the control (black control, cyan control, and yellow control). However, the magenta toner of the present disclosure (magenta 1) had a higher level of JMT2000, including the presence of TS530 than the control (magenta control). This change from the control was pursued in order to improve the Tribo/TC and dispense clogging performance of the magenta toner. In Table 3 below, JMT2000 is Titanium, RY50 is Small Silica, X24 is Large Silica and TS530 is Small Silica.

TABLE 3

| | Toner Additive Package | | | | | |
|---|---|---|---|---|---|---|
| Toner Color | JMT2000 | RY50 | X24 | CeO2 | ZnS (S) | TS530 |
| Cyan 1 | 0.88 | 1.71 | 1.73 | 0.55 | 0.2 | NA |
| Cyan Control | 0.88 | 1.71 | 1.73 | 0.55 | 0.2 | NA |
| Magenta 1 | 1.32 | 1.71 | 1.73 | 0.55 | 0.2 | 0.3 |

TABLE 3-continued

| Toner Color | Toner Additive Package | | | | | |
|---|---|---|---|---|---|---|
| | JMT2000 | RY50 | X24 | CeO2 | ZnS (S) | TS530 |
| Magenta Control | 0.88 | 1.71 | 1.763 | 0.55 | 0.2 | NA |
| Yellow 1 | 0.88 | 1.71 | 1.73 | 0.55 | 0.2 | NA |
| Yellow Control | 0.88 | 1.71 | 1.73 | 0.55 | 0.2 | NA |
| Black 1 | 0.88 | 1.71 | 1.73 | 0.55 | 0.2 | NA |
| Black Control | 0.88 | 1.71 | 1.73 | 0.55 | 0.2 | NA |

The properties of both the toner of the present disclosure and the control toner with the additive package noted above were determined. The ranges achieved for both primary and supplemental properties are set forth in Tables 4 and 5 below, respectively.

TABLE 4

| Toner Primary Properties | Control (Measured Reference/ Quoted Specification) | Cyan 1 | Black 1 | Magenta 1 | Yellow 1 |
|---|---|---|---|---|---|
| Vol. Median Diameter (D50) | 5.6 ± 0.4 | 5.6 ± 0.4 | 5.6 ± 0.5 | 5.6 ± 0.5 | 5.6 ± 0.5 |
| Upper Vol. GSD (D84/D50) | <1.23 | <1.23 | <1.23 | <1.23 | <1.23 |
| Lower No. GSD (D50/D16) | <1.3 | <1.3 | <1.3 | <1.3 | <1.3 |
| Tribo Additive Content | 37-62 | 37-62 | 37-62 | 37-62 | 37-62 |
| % $SiO_2$ | 2.75-4.13 | 2.75-4.13 | 2.75-4.13 | 36-4.45 | 2.75-4.13 |
| % $TiO_2$ | 0.7-1.06 | 0.7-1.06 | 0.7-1.06 | 1.07-1.53 | 0.7-1.06 |
| % $CeO_2$ | 0.45-0.65 | 0.45-0.65 | 0.45-0.65 | 0.45-0.65 | 0.45-0.65 |
| % Zn | 0.16-0.24 | 0.16-0.24 | 0.16-0.24 | 0.16-0.24 | 0.16-0.24 |

TABLE 5

| Toner Supplemental Properties | Control (Measured Reference/ Quoted Specification) | Cyan 1 | Black 1 | Magenta 1 | Yellow 1 |
|---|---|---|---|---|---|
| % Cohesion | 12-30 | 12-30 | 12-30 | 12-30 | 12-30 |
| AAFD 3K | 65-80 | 35-55 | 35-55 | 35-55 | 35-55 |
| 6K | TBD | 20-40 | 20-40 | 20-40 | 20-40 |
| 12K | 30-50 | 2-20 | 2-20 | 2-20 | 2-20 |
| BFE | TBD | 50-73 | 50-73 | 50-73 | 50-73 |

The Basic Flow Energy (BFE) for the toners was the same; 3K (which is 3000 Joules), 6K (which is 6000 Joules) and 12K (which is 12000 Joules). The lower AAFD (additive attachment force detector), or the less strongly attached silica on the surface of the toner of the present disclosure, indicated reduced toner dispense clogging, without sacrificing image and print quality. Also, the magenta toner of the present disclosure had higher % SiO2 and % TiO2 due to the increase in JMT2000 and presence of TS530, which enabled similar charging performance with superior dispense clogging versus the control toner.

Example 3

The color toners of Example 2, including both toners of the present disclosure and control toners, were subjected to DAA, i.e., Document Analysis Area Internal Machine Testing which a WorkCentre Pro C2128/C2636/C3545™ copier from Xerox Corporation is capable of running to analyze image and print quality.

Tables 6 and 7 below include the ranges observed in DM testing during qualification. Included are the results for both toners of the present disclosure and control toners from FujiXerox. Machine testing included a total of 45,000 prints, with testing conducted across 3 environmental conditions. The Zone transitions included 15,000 copies in B zone (70/50), 15,000 copies in J zone (70/10), and 15,000 copies in A zone (80/80). Print tests and samples were taken at 5000 print intervals, providing 3 data points per zone. Toner Concentration (TC) Triboelectric charging (Tribo) and other color measurements within the purview of those skilled in the art are set forth below in Tables 6 and 7.

An explanation of the terms and abbreviations found in Tables 6 and 7 is as follows:

L-Star (L*): This is the lightness value parameter which indicates how light or dark a color is.

C-Star (C*): This parameter is the calculated vector distance from the center of color space to the measured color. Larger C* values indicate higher chromaticity.

Delta E: The result of a mathematical formula comprised of various color measurement parameters to correlate by quantitative measure with the sensitivity of the human eye.

Density %: Measured output density from a range of input levels (100%, 60%, 20%). Input levels are defined as the amount of covered area of a given area.

AC: An abbreviation for percentage of area coverage. This is defined by measurement as the amount of area covered by toner on an entire document.

Background Delta E: A calculated value representing the difference (in color space) of a clean sheet of paper and one that has been used in a reprographic operation.

Banding Unif Lateral Direction: A calculated value representing the ratio of uniformity disturbance caused by non-uniform density bands in a cross-process direction within a defined area.

Banding Unif Process Direction: A calculated value representing the ratio of uniformity disturbance caused by non-uniform density bands in a process direction within a defined area.

TABLE 6

| DAA Performance Metric | Cyan 1 | Cyan Control | Magenta 1 | Magenta Control |
|---|---|---|---|---|
| Density 100% | 1.32-1.46 | 1.27-1.34 | 1.26-1.31 | 1.23-1.33 |
| Density 60% | 0.58-0.65 | 0.53-0.62 | 0.57-0.69 | 0.58-0.65 |

TABLE 6-continued

| DAA Performance Metric | Cyan 1 | Cyan Control | Magenta 1 | Magenta Control |
|---|---|---|---|---|
| Density 20% | 0.21-0.23 | 0.22-0.25 | 0.24-0.29 | 0.25-0.27 |
| L-star | 53.79-56.14 | 55.2-58.4 | 49.43-50.18 | 48.4-50.6 |
| C-star | 57.32-59.85 | 54.7-58.4 | 68.74-69.9 | 68.1-71.4 |
| Gloss | 40.31-46.11 | 35.4-40.8 | 42.28-50.21 | 39.6-46.9 |
| Proj. Eff | 50-53 | 46-49 | 50-52 | 51-53 |
| Fusing | 10-23.89 | 10-40 | 10-26.11 | 10-25 |
| Background (Bkg) | 0 | 0 | 0 | 0 |
| Bkg deltaE | 4.19-4.51 | 4.03-4.68 | 4.32-4.54 | 4.11-4.57 |
| Banding unif Lateral Direction | 0.48-0.69 | 0.45-0.92 | 0.51-0.62 | 0.48-0.91 |
| Banding unif Process Direction | 0.54-0.67 | 0.59-0.72 | 0.54-0.64 | 0.59-0.73 |
| Mottle | 2-3 | 1.67-3 | 1.94-3 | 1.3-3 |
| Graininess | 2-3 | 1.67-3 | 2-2.61 | 1.7-3 |
| Starvation | 2-3.1 | 1.17-2.94 | 1.83-2 | 1-3 |
| TC | 8.27-8.74 | 7.3-10.6 | 9.59-9.74 | 7.7-10.3 |
| Tribo | 33.58-35.05 | 26.8-35.2 | 27.41-27.87 | 24.2-34 |
| A(t) | 414-434 | 367-424 | 368-379 | 325-463 |
| Yield @ 9% AC (copies/cartridge) | 17721-20072 | 18316-21204 | 21051-23918 | 21204-23408 |
| Delta E 100% halftone | 1.32-3.26 | 0.24-1.02 | 0.31-4.29 | 0.13-1.94 |
| Delta E 50% halftone | 1.83-3.09 | 0.19-2.29 | 0.77-4.82 | 0.18-2.4 |
| | Average (n = 5) | Average (n = 19) | Average (n = 2) | Average (n = 18) |
| Clogging - # copies | 376 | 339 | 400 | 280 |
| Clogging - pass rate | 90% | 68% | 100% | 56% |

TABLE 7

| DAA Performance Metric | Yellow 1 | Yellow Control | Black 1 | Black Control |
|---|---|---|---|---|
| Density 100% | 1.32-1.66 | 1.39-1.54 | 1.57-1.8 | 1.60-1.85 |
| Density 60% | 0.53-0.69 | 0.51-0.61 | 0.96-1.01 | 0.98-1.02 |
| Density 20% | 0.2-0.27 | 0.2-0.25 | 0.26-0.29 | 0.26-0.28 |
| L-star | 89.16-89.5 | 89.3-89.4 | 12.85-22.38 | 13.3-19.6 |
| C-star | 86.87-102.25 | 89.7-96.1 | n/a | n/a |
| Gloss | 46.44-57.87 | 41.9-49 | 38.44-50.33 | 32.6-46.5 |
| Proj. Eff | 40-46 | 36-39 | n/a | n/a |
| Fusing | 10-24.81 | 10-26.7 | 20-37.78 | 20-40 |
| Bkg | 0 | 0 | 0 | 0 |
| Bkg deltaE | 4.1-4.52 | 4.04-4.54 | 4.1-4.54 | 4.2-4.6 |
| Banding unif Lateral Direction | 0.48-0.76 | 0.46-0.92 | 0.49-0.7 | 0.46-0.61 |
| Banding unif Process Direction | 0.57-0.63 | 0.54-0.69 | 0.54-0.71 | 0.62-0.72 |
| Mottle | 1.7-2.28 | 1.17-2.06 | 1.56-3 | 1.7-3 |
| Graininess | 1.89-2.7 | 1.67-2.17 | 2-2.56 | 1.7-3 |
| Starvation | n/a | n/a | 1.83-3 | 1.3-3 |
| TC | 7.81-8.67 | 7.42-10.35 | 7.65-9.68 | 8.4-10.4 |
| Tribo | 31.17-38.39 | 28.4-38.2 | 27.69-30.37 | 23.9-30.7 |
| A(t) | 375-459 | 355-547 | 325-375 | 324-414 |
| Yield @ 9% AC (copies/cartridge) | 16089-20519 | 18000-20346 | 19360-23229 | 18459-21472 |
| Delta E 100% halftone | 1.11-3.06 | 0.09-1.01 | n/a | n/a |
| Delta E 50% halftone | 0.41-4 | 0.28-2.28 | n/a | n/a |
| | Average (n = 6) | Average (n = 18) | Average (n = 5) | Average (n = 24) |
| Clogging - # copies | 395 | 368 | 386 | 261 |
| Clogging - pass rate | 96% | 89% | 90% | 54% |

As observed from Tables 6 and 7, the toner of the present disclosure had superior clogging performance versus the control toner, which was achieved through the low blend time process. Also, the gloss was typically higher for the toner of the present disclosure compared with the control toner. The gloss was tested using a Free Belt Nip Fuser fixture (FBNF) with Digital Color Grade (DCG) and Color Expressions Plus paper (CX+), using Transferred Mass Area (TMA) (mg/cm2) of 0.40 and 1.05, respectively, at a speed of 165 mm/sec.

Figure 1B:
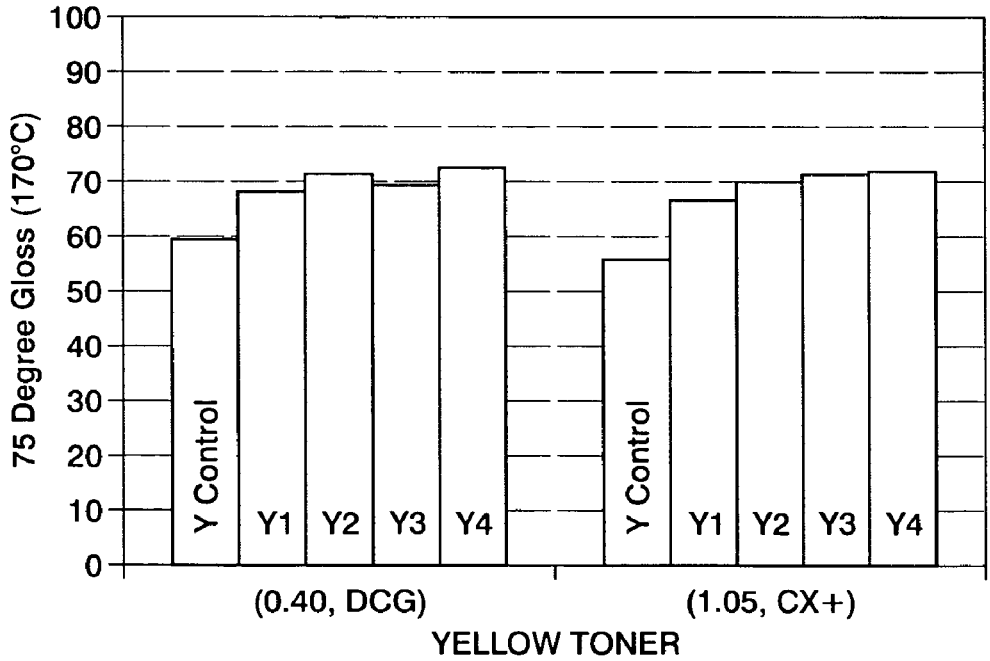
FIG. 1B is a graph depicting the degree gloss of yellow toners of the present disclosure with a control toner.
Figure 1C:
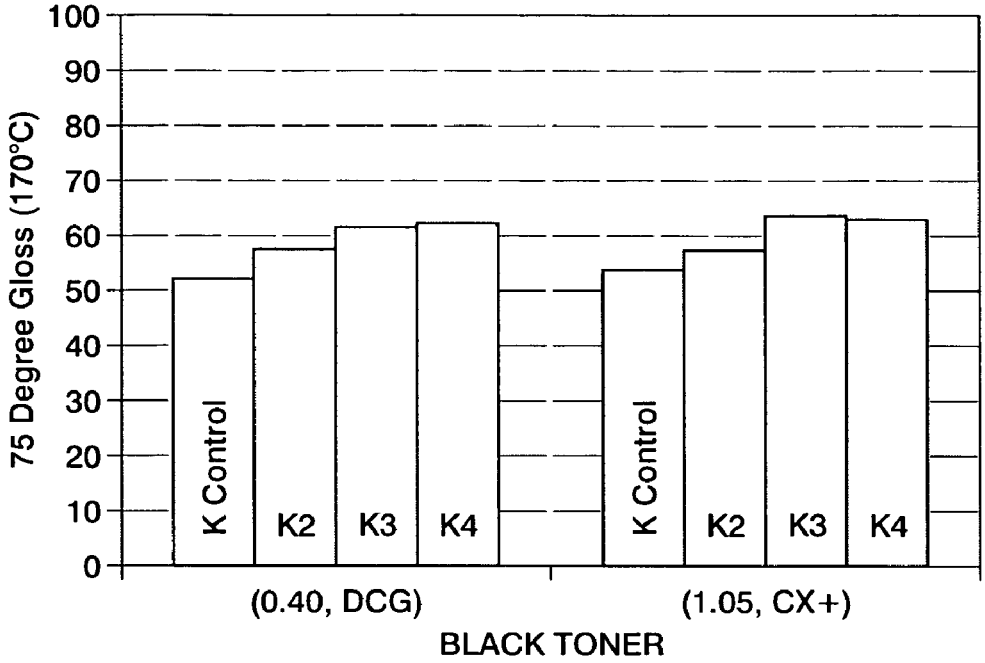
FIG. 1C is a graph depicting the degree gloss of black toners of the present disclosure with a control toner.
Figure 1D:
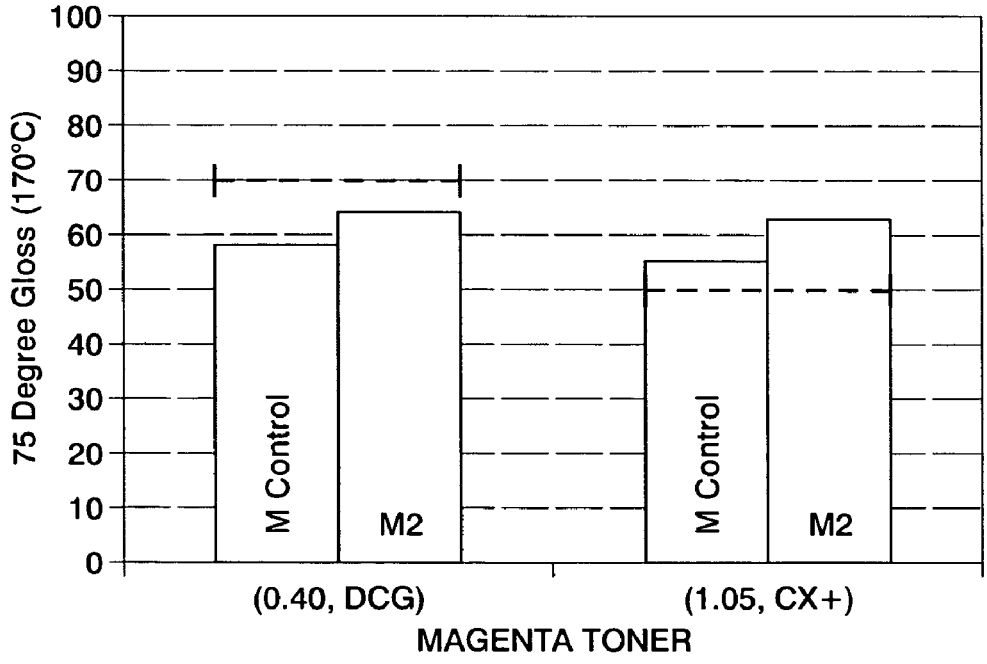
FIG. 1D is a graph depicting the degree gloss of a magenta toner of the present disclosure with a control toner.

The results of the gloss test are set forth in FIGS. 1A, 1B, 1C and 1D for each color, i.e., cyan (C), yellow (Y), black (K), and magenta (M), respectively. Four lots were tested for cyan and yellow, three lots for black, and one for magenta, and then compared with a control for each color from Example 2. The toner of the present disclosure demonstrated a higher gloss measurement of about 5 to about 10 units versus the control.

Figure 2A:
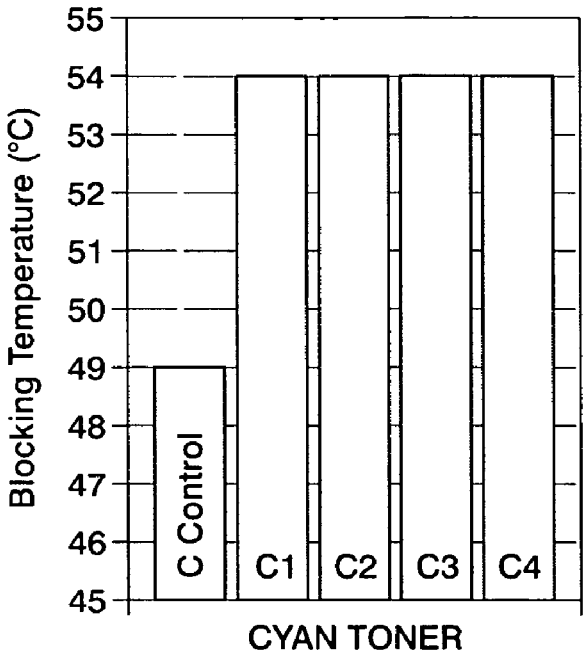
FIG. 2A is a graph depicting the blocking temperature of cyan toners of the present disclosure compared with a control toner.
Figure 2B:
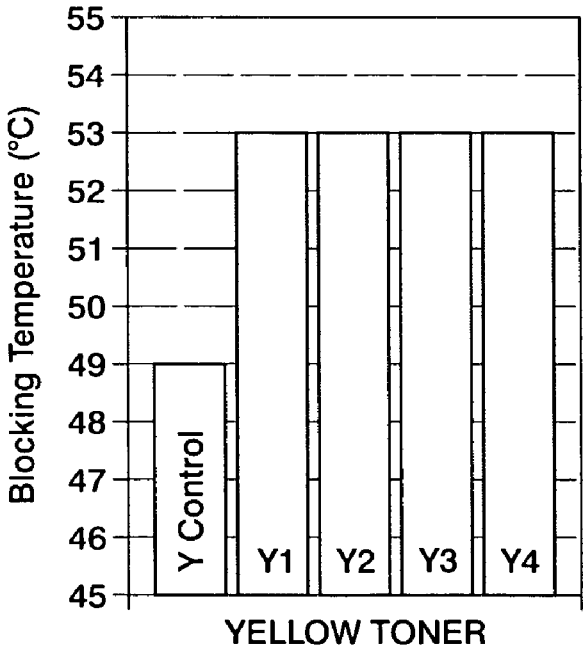
FIG. 2B is a graph depicting the blocking temperature of yellow toners of the present disclosure compared with a control toner.
Figure 2C:
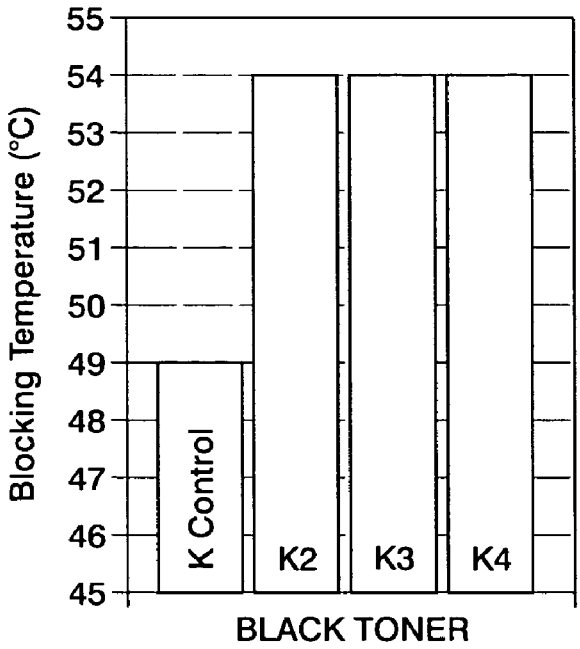
FIG. 2C is a graph depicting the blocking temperature of black toners of the present disclosure compared with a control toner.
Figure 2D:
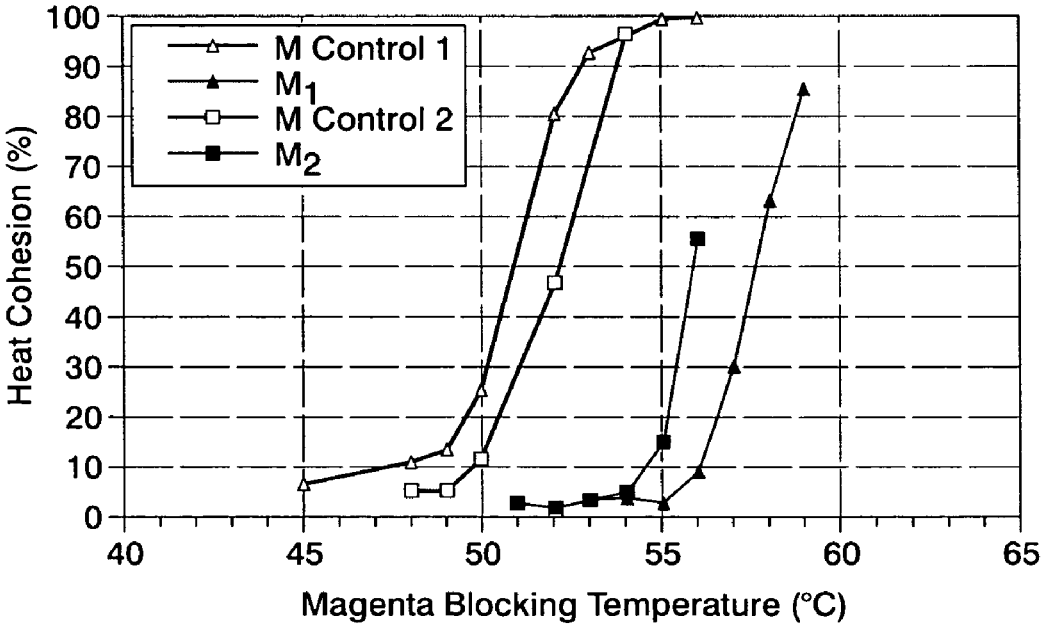
FIG. 2D is a graph depicting the blocking temperature of magenta toners of the present disclosure compared with a control toner and the heat cohesion of such toners.

The blocking temperature for toners of the present disclosure was also compared with the control toner. The blocking temperature for both the control toner and toner of the present disclosure was also obtained through the Heat of Cohesion Measurement, which was obtained by using the Hosokawa measurement system at elevated temperatures. The results of the blocking tests are set forth in FIGS. 2A, 2B, 2C and 2D for each color, i.e., cyan, yellow, black, and magenta. Four lots of cyan and yellow, three lots of black, and two lots of magenta were tested and compared with a control for each color from Example 2, except for magenta, which utilized two commercially available magenta toners as controls. The two magenta controls were: a magenta toner commercially available from Xerox Corporation; and a magenta toner commercially available from FujiXerox. Both magenta controls had a lower blocking temperature of about 47 C to about 49 C and are currently utilized with DOCUCOLOR 3535™ and WorkCentre Pro C2128/C2636/C3545™ color copiers sold by Xerox Corporation. The toners of the present disclosure had a blocking temperature about 4 to about 5 degrees Celsius higher, due to the higher Tg shell latex design.

Example 4

Toners of the present disclosure were produced by combining the toners described in Example 1 with the additive package described in Example 2 by blending Cyan, Black, and Yellow toner materials at varying specific energies. The blending energies were varied as described below in Tables 8 and 9, with both low and high energies utilized for each color (and referred to in the Tables, as $Y_{high}$, $Y_{low}$, $C_{high}$, $C_{low}$, and $K_{high}$ and $K_{low}$). The results of this test are set forth below in Tables 8 and 9 below. A dispense clogging 'Pass', included those machines that reached 400 prints without a dispense clogging failure.

TABLE 8

| Parent Particle ID | Blend Specific Energy (W-hr/lb) | DAA Machine 1 | DAA Machine 2 | DAA Machine 3 | DAA Machine 4 |
|---|---|---|---|---|---|
| $Y_{high}$ | 22 | 97 | 222 | 189 | 124 |
| $Y_{low}$ | 6 | 400 | 400 | 400 | 400 |
| $C_{high}$ | 20 | 196 | 243 | 400 | 400 |
| $C_{low}$ | 7 | 400 | 400 | 400 | 400 |
| $K_{high}$ | 30 | 75 | 70 | 61 | 100 |
| $K_{low}$ | 5 | 400 | 400 | 400 | 400 |

TABLE 9

| Parent Particle ID | Machine Dispense Clogging Results | Average Prints to Failure | AAFD (3KJ) | AAFD (12KJ) | Basic Flow Energy (mJ) |
|---|---|---|---|---|---|
| $Y_{high}$ | 0 Pass 4 Fail | 158 | 74.9 | 34 | 82 |
| $Y_{low}$ | 4 Pass 0 Fail | PASS | 50.6 | 13.8 | 72 |
| $C_{high}$ | 2 Pass 2 Fail | 310 | 76.3 | 38.4 | 74 |
| $C_{low}$ | 4 Pass 0 Fail | PASS | 50.7 | 14 | 71 |
| $K_{high}$ | 0 Pass 4 Fail | 77 | 77.5 | 44.9 | 80 |
| $K_{low}$ | 4 Pass 0 Fail | PASS | 61.1 | 24 | 67 |

It was found that a clear dispense failure signal correlated to a higher blending energy, while clogging was avoided with a lower blending energy. It was found that toner particles blended from about 3 W-hr/lb to about 10 W-hr/lb, with additive attachment (as evidenced by AAFD) at 3 KJ below 65% SIO2 remaining, and 12 KJ below 25% SiO2 remaining, all passed the dispense clogging test (that is, they did not clog), without any failures. Also, the toners that passed dispense clogging all contained Basic Flow Energy below 73 mJ. Nominal particles blended above about 10 W-hr/lb produced toners that consistently failed with additive attachment at 3 KJ greater than 65% SIO2 remaining, and 6 KJ greater than 25% SiO2 remaining. Also, toners that exhibited dispense clogging failure all contained Basic Flow Energy above 73 mJ.

Thus, the toners of the present disclosure, which utilized specific energy of from about 3 W-hr/lb to about 10 W-hr/lb in additive blending are able to obtain additive attachment at 3 KJ below 65% SIO2 remaining, and 12 KJ below 25% SiO2 remaining, with Basic Flow Energy achieving below about 73 mJ. These toner attributes ensure that customers will not experience gross dispense clogging failure using high toner demand (single color), low developer housing process speed (Heavyweight 2 mode), and high duty cycle 2 mode (52 mm/sec). (These modes may be used by customers utilizing the COPYCENTRE™ C3545 copy machine available from Xerox Corporation).

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A toner comprising:

a core comprising a first latex comprising a styrene/butyl acrylate copolymer comprising from about 70% by weight to about 78% by weight styrene and from about 22% by weight to about 30% by weight butyl acrylate, and having a glass transition temperature from about 45° C. to about 54° C.; and a shell surrounding said core comprising a second latex comprising a styrene/butyl acrylate copolymer comprising from about 79% by weight to about 85% by weight styrene and from about 15% by weight to about 21% by weight butyl acrylate, and having a glass transition temperature from about 55° C. to about 65° C.

2. The toner of claim 1, wherein the first latex has a glass transition temperature from about 49° C. to about 53° C., and the latex in the shell has a glass transition temperature from about 57° C. to about 61° C.

3. The toner composition according to claim 1, wherein the toner further comprises a colorant and at least one additive selected from the group consisting of surfactants, coagulants, surface additives, and mixtures thereof.

4. The toner composition according to claim 3, wherein the toner comprises an emulsion aggregation toner and the at least one additive is from about one to about twenty additives selected from the group consisting of metal salts, metal salts of fatty acids, colloidal silicas, metal oxides, strontium titanates, and combinations thereof.

5. The toner of claim 1, wherein the toner possesses a gloss from about 20 GGU to about 120 GGU.

6. A toner comprising:

a core comprising a first latex comprising a styrene/butyl acrylate copolymer comprising from about 74% by weight to about 77% by weight styrene and from about 21% to about 25% by weight butyl acrylate, and having a glass transition temperature from about 45° C. to about 54° C.; and a shell surrounding said core comprising a second latex comprising a styrene/butyl acrylate copolymer comprising from about 81% by weight to about 83% by weight styrene, and from about 17% to about 19% by weight butyl acrylate, and having a glass transition temperature from about 55° C. to about 65° C.

7. The toner of claim 6, wherein the first latex has a glass transition temperature from about 49° C. to about 53° C., and the latex in the shell has a glass transition temperature from about 57° C. to about 61° C.

8. The toner composition according to claim 6, wherein the toner further comprises a colorant and at least one additive selected from the group consisting of surfactants, coagulants, surface additives, and mixtures thereof.

9. The toner composition according to claim 8, wherein the toner comprises an emulsion aggregation toner and the at least one additive is from about one to about twenty additives selected from the group consisting of metal salts, metal salts of fatty acids, colloidal silicas, metal oxides, strontium titanates, and combinations thereof.

10. The toner of claim 6, wherein the toner possesses a gloss from about 20 GGU to about 120 GGU.

* * * * *